US007060019B2

(12) United States Patent
Hermeler et al.

(10) Patent No.: US 7,060,019 B2
(45) Date of Patent: Jun. 13, 2006

(54) SOLID BOWL SCREW CENTRIFUGE COMPRISING A DISTRIBUTOR

(75) Inventors: Jürgen Hermeler, Haltern (DE); Paul Brüning, Oelde (DE); Ludger Horstkötter, Ennigerloh (DE)

(73) Assignee: Westfalia Separator AG, Oelde (DE)

( * ) Notice: Subject to any disclaimer, the term of this patent is extended or adjusted under 35 U.S.C. 154(b) by 329 days.

(21) Appl. No.: 10/416,548

(22) PCT Filed: Oct. 9, 2001

(86) PCT No.: PCT/EP01/11663

§ 371 (c)(1),
(2), (4) Date: May 13, 2003

(87) PCT Pub. No.: WO02/40175

PCT Pub. Date: May 23, 2002

(65) Prior Publication Data

US 2004/0029697 A1 Feb. 12, 2004

(30) Foreign Application Priority Data

Nov. 14, 2000 (DE) ..... 100 65 893
Apr. 28, 2001 (DE) ..... 101 20 995

(51) Int. Cl.
*B04B 1/20* (2006.01)

(52) U.S. Cl. ..... 494/53

(58) Field of Classification Search ..... 494/52–54, 494/56, 84; 210/377, 380.1, 380.3
See application file for complete search history.

(56) References Cited

U.S. PATENT DOCUMENTS 2,703,676 A * 3/1955 Gooch ..... 494/53
3,096,282 A * 7/1963 Trotter, Jr. ..... 494/53
3,428,246 A * 2/1969 Finkelston ..... 210/377
3,568,919 A * 3/1971 Nielsen ..... 494/53
4,142,669 A * 3/1979 Burlet ..... 494/84
4,298,160 A * 11/1981 Jackson ..... 494/53
5,310,399 A 5/1994 Suzuki
5,374,234 A * 12/1994 Madsen ..... 494/53
5,403,486 A 4/1995 Leung
5,527,258 A * 6/1996 Leung et al. ..... 494/53
5,819,110 A 10/1998 Motoyama
6,030,332 A 2/2000 Hensley
6,063,292 A 5/2000 Leung
6,122,565 A 9/2000 Wenning et al.
6,328,897 B1 12/2001 Leung
2004/0029697 A1* 2/2004 Hermeler et al. ..... 494/53

FOREIGN PATENT DOCUMENTS

DE 12 72 231 4/1964
DE 12 93 089 4/1969

(Continued)

*Primary Examiner*—Charles E. Cooley
(74) *Attorney, Agent, or Firm*—Barnes & Thornburg LLP

(57) ABSTRACT

The present invention relates to solid bowl screw centrifuge comprising a centrifuging chamber having a rotatable screw with a center axis and a rotatable drum surrounding the centrifuging chamber. Also included is an axially extending inflow tube for guiding material to be centrifuged into a distributor. The distributor is oriented in a substantially perpendicular manner with respect to the center axis of the screw and configured for introducing the material to be centrifuged into the centrifuging chamber. The distributor further includes at least one wall having a surface structure that includes projections configured such that a substantial portion of the material to be centrifuged flowing through the distributor must flow around at least one of the projections.

32 Claims, 8 Drawing Sheets

FOREIGN PATENT DOCUMENTS

| | | | | |
|---|---|---|---|---|
| DE | 14 82 721 | | | 6/1969 |
| DE | 2057555 | | * | 6/1972 |
| DE | 26 17 692 | | | 11/1977 |
| DE | 25 51 882 | B2 | | 6/1978 |
| DE | 3723864 | A1 | * | 1/1989 |
| DE | 4132 693 | A1 | | 10/1991 |
| DE | 43 20 265 | | | 12/1994 |
| EP | 557 758 | | | 2/1993 |
| EP | 0 806 245 | | | 4/1996 |
| EP | 0 891 814 | A2 | | 1/1999 |
| FR | 1 449 064 | | | 7/1966 |
| FR | 2 532 198 | | | 8/1982 |
| GB | 998 669 | | | 7/1965 |
| IT | 496031 | | | 6/1954 |
| SU | 385 629 | | | 10/1973 |
| WO | 93/13865 | | * | 7/1993 |
| WO | WO 97/23295 | | | 7/1997 |
| WO | WO 98/45045 | | | 10/1998 |
| WO | WO 99/52641 | | | 10/1999 |
| WO | 01/32314 | | * | 5/2005 |

* cited by examiner

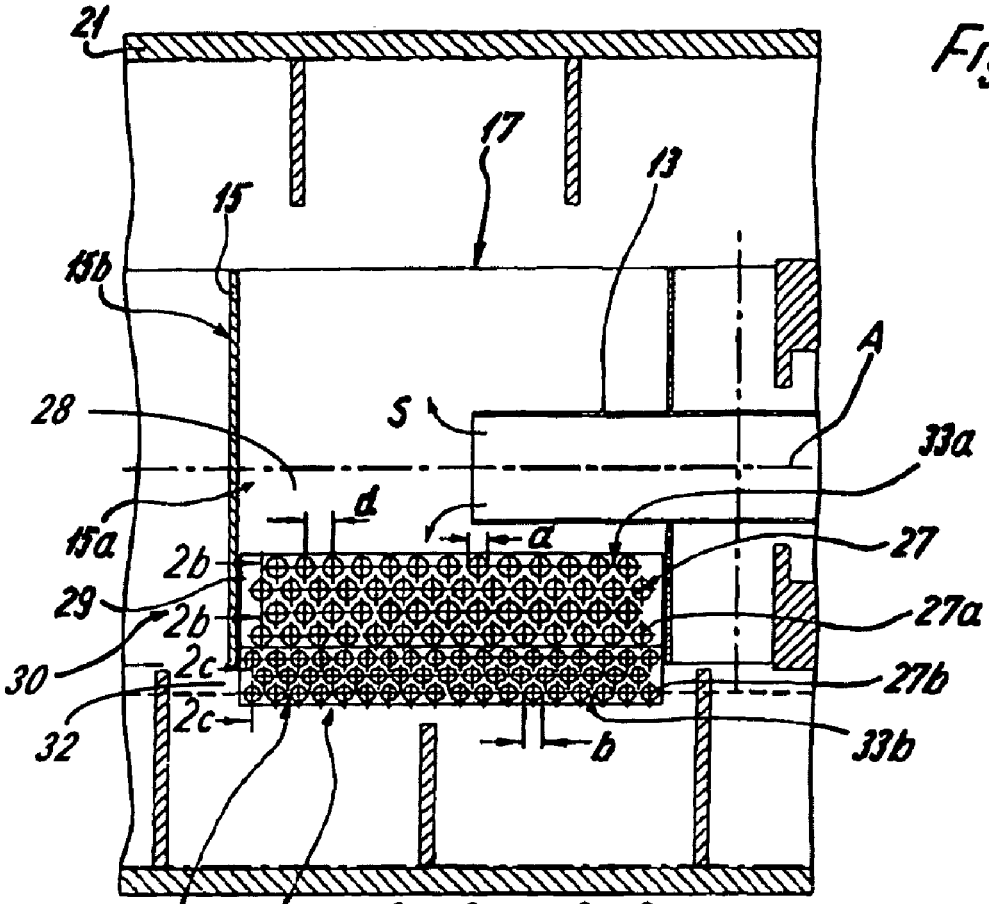
Fig. 2a
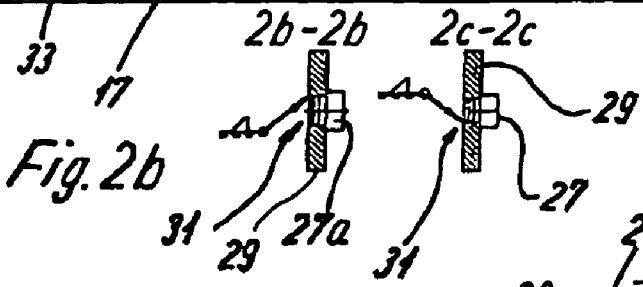
Fig. 2b
Fig. 2c
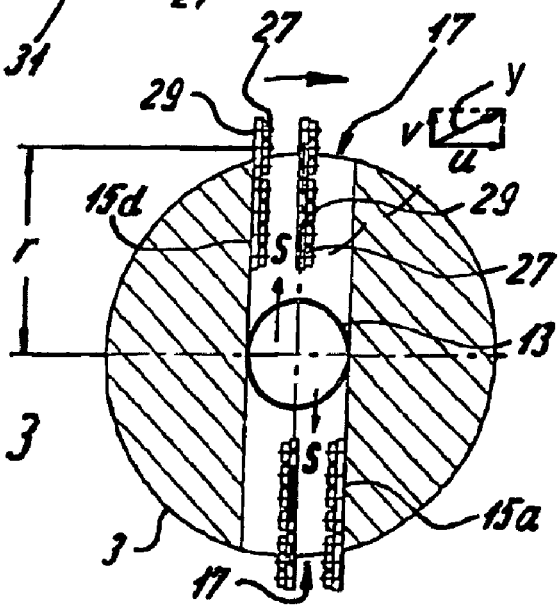
Fig. 3 possible
directions of the
relative velocities drum axis v rel = component of the relative velocity of the product at the outer edge of the distributor (may be radially to axially directed)

u Sch Sp = circumferential speed of the screw at the liquid level surface level

Prior Art without measures for reducing the radial dirve of the relative velocities with measures

SOLID BOWL SCREW CENTRIFUGE COMPRISING A DISTRIBUTOR

BACKGROUND AND SUMMARY OF THE INVENTION

The present invention relates to a solid bowl screw centrifuge having a rotating drum which surrounds a centrifuging chamber having a screw which also rotates. The centrifuge also has a distributor preferably constructed as a tube for introducing the material to be centrifuged into the centrifuging chamber. The distributor is oriented in an angular manner, particularly perpendicularly, with respect to the center axis of the screw, the material to be centrifuged being guided through an axially extending inflow tube into the distributor.

In the case of solid bowl screw centrifuges, the material to be centrifuged is to be accelerated to the circumferential speed of the screw at the diameter of the liquid level (surface) in the screw channel. The relative velocity at the entry into the centrifuging chamber of the liquid surface is to be as low as possible.

As a result of the acceleration to the circumferential speed of the screw at the liquid level diameter on the driving walls of the distributor, a surface flow is created in the distributor whose velocity increases considerably with the radius, specifically to a value which is approximately equal to the circumferential speed of the screw at the liquid level diameter.

From U.S. Patent Document U.S. Pat. No. 5,403,486, it is known to provide the area of the feeding of material to be centrifuged, in the widest sense of the word, the distributor, of a solid bowl screw centrifuge with a larger number of outlet openings which are aligned at various angles with respect to one another. However, this requires relatively high expenditures and, in addition, no lowering of the relative velocity is achieved.

From German Patent Document DE 1 293 089, it is known to cover nozzle-type distributor openings in the centrifuging chamber with a baffle plate which deflects the material to be centrifuged in order to reduce flows. However, this measure is not sufficient for an effective reduction of swirls.

The invention develops the solid bowl screw centrifuge of the above-mentioned type such that the relative velocity of the material to be centrifuged is reduced in a constructively simple manner when entering the liquid surface.

The present invention is a solid bowl screw centrifuge comprising a centrifuging chamber having a rotatable screw with a center axis and a rotatable drum surrounding the centrifuging chamber. It also includes an axially extending inflow tube for guiding material to be centrifuged into a distributor, the distributor being oriented in a substantially perpendicular manner with respect to the center axis of the screw and configured for introducing the material to be centrifuged into the centrifuging chamber. The distributor further includes at least one wall having a surface structure that includes projections configured such that a substantial portion of the material to be centrifuged flowing through the distributor must flow around at least one of the projections on an essentially radial path that extends in a direction of a centrifugal force such that the projections exercise a braking effect which counteracts an acceleration of the material to be centrifuged. The distributor may also or alternatively include at least one wall having a step-shaped surface structure extending in a circumferential direction.

According to another embodiment, at least one wall of the distributor is provided with a surface structure consisting of at least two or more radially mutually offset rows of projections. The projections of the rows are axially offset with respect to one another such that essentially no radial free flow channels are formed on the wall.

The embodiments of the present invention provide for an effective and nevertheless simple and relatively inexpensive manner such that at least the essential portion of the material to be centrifuged, but preferably the entire material to be centrifuged, can no longer flow in a direct radial path out of the inflow tube into the centrifugal chamber. Here, the word "radial" applies to the direction on the distributor wall in which the material to be centrifuged will essentially flow into the centrifuging chamber during the rotation of the distributor as a result of the centrifugal force. The term "radial" may also comprise an axial movement component and/or a circumferential component. It is important that at least the essential portion of the material to be centrifuged does not flow directly "in the direction of the centrifugal force" into the centrifuging chamber.

Although it is known from German Patent Document DE PS 1 272 231 to construct several grinding or crushing bodies on the distributor wall, direct paths radially into a centrifuging chamber still exist between these bodies so that a liquid is essentially not braked but enters the centrifuging chamber at an unchanged high velocity. The possibility of a benefit of projections for reducing the relative velocity of the material to be centrifuged when entering into liquid surface in a constructively simple manner was not recognized here.

According to another embodiment of the present invention, the projections are constructed as circular, rhombic or other n-cornered knobs.

In another embodiment of the present invention, the projections have a meander shape.

According to another embodiment of the present invention, at least one wall of the distributor is provided with a step-type surface structure which extends in the circumferential direction and which also causes a braking, among other things, as a result of swirls.

For all the embodiments of the present invention, the projections may be constructed as metal plates.

These and other aspects of the present invention will become apparent from the following detailed description of the invention, when considered in conjunction with accompanying drawings.

BRIEF DESCRIPTION OF THE DRAWINGS

FIG. 2*a* is a sectional view of an inflow area of a distributor into a centrifuging chamber of the solid bowl screw centrifuge, according to the present invention.

FIG. 2*b* is a sectional view along the line 2*b*—2*b* of FIG. 2*a*.

FIG. 2*c* is a sectional view along the line 2*c*—2*c* of FIG. 2*a*.

FIG. 3 is a schematic sectional view of a distributor of FIG. 1.

DETAILED DESCRIPTION OF THE PREFERRED EMBODIMENTS

Figure 1:
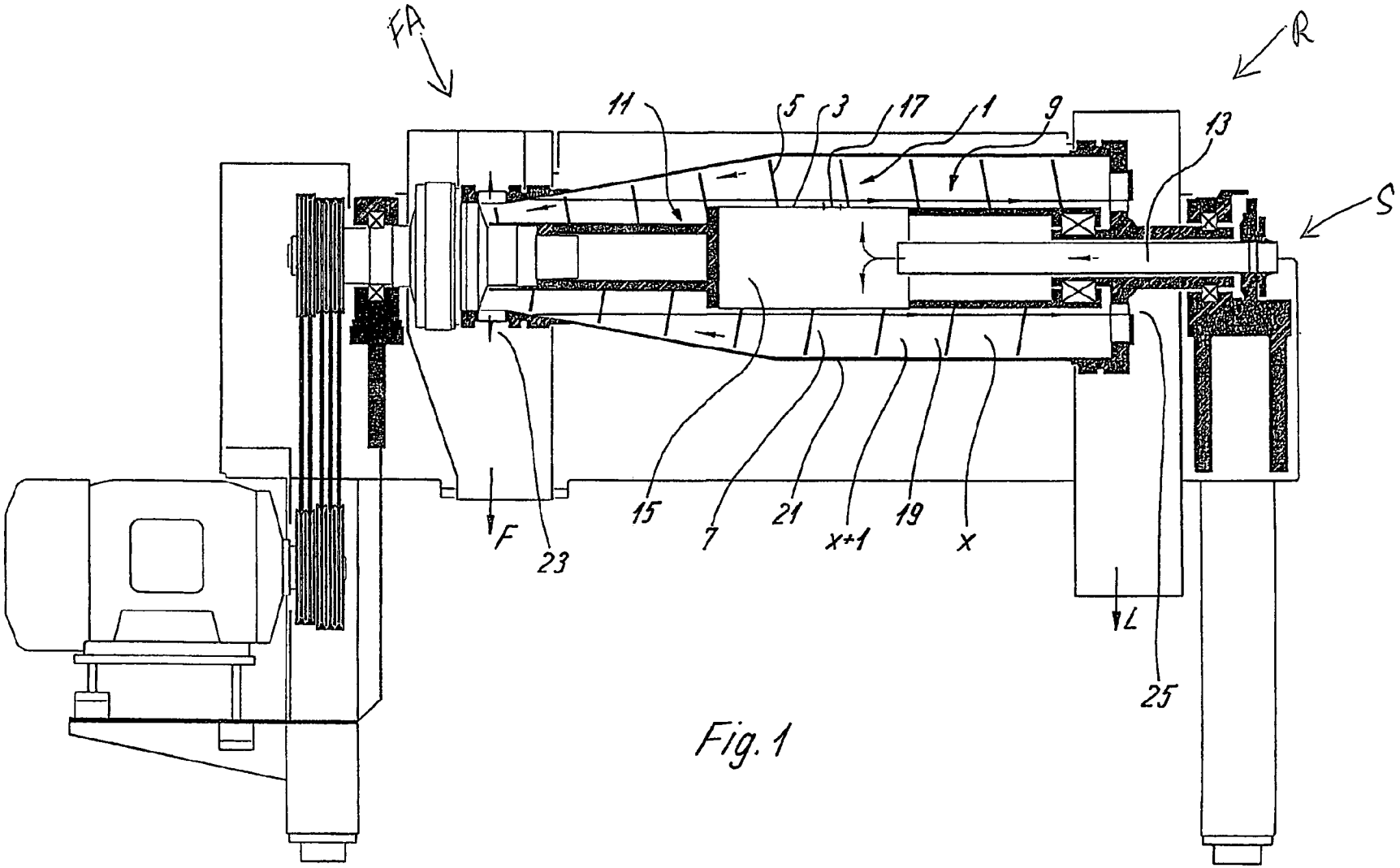
FIG. 1 is a sectional view of a solid bowl screw centrifuge, according to the present invention.

FIG. 1 illustrates a solid bowl screw centrifuge with a screw 1 which has a screw body 3 as well as, in this case, a screw blade 5 which surrounds the screw body 3 in a helical manner. Between the screw spirals x, x+1, . . . , a screw channel 7 is formed or constructed for conveying/transporting a material to be processed.

In a rear area R which is shown to the right when viewing FIG. 1, the screw body 3 has a cylindrical section 9 and, in a forward area FA, which adjoins area R, as seen in FIG. 1, the screw body 3 has a tapering section 11, which tapers in steps and which may, as an alternative, be conically shaped.

Material S to be centrifuged is guided through a centrally arranged inflow tube 13 into a distributor 15 and is then guided from there through radial openings 17 in the distributor 15 into a centrifuging chamber 19 of the screw 1. A drum 21 surrounds the screw 1.

The material S to be centrifuged is accelerated when passing through the distributor 15 and when entering into the centrifuging chamber 19. As a result of the effect of centrifugal force, solid particles F will deposit on a drum wall within a very short time.

The screw rotates 1 at a slightly lower or higher speed than the drum 21 and conveys the centrifuged solids F toward the tapered section 11 out of the drum 21 via the solids discharge 23.

In contrast, liquid L flows to larger drum diameter area R at the rearward end of the drum 21, and the liquid L is discharged there at overflow 25.

FIG. 2*a* shows inflow tube 13 which projects into the distributor 15 which has an essentially rectangular cross-section and is thus essentially constructed as a rectangular tube. Alternative constructions are naturally conceivable, such as a construction of the distributor 15 as a tube structure including two mutually crossing rectangular tubes or as tubes which are not oriented perpendicular to drum axis A but is at an angle thereto. Furthermore, cross-section geometries can be implemented which deviate from a rectangular cross-section.

At the moment of exit from the inflow tube 13, the material S to be centrifuged entering the distributor 15 moves at an axial flow velocity in the inflow tube 13. When entering the distributor 15, material S is then taken along by the distributor 15. The material S to be centrifuged therefore rotates along with the distributor 15 and thus moves essentially to an outer radial edge of distributor 15 because of the centrifugal force in the distributor 15.

In the area of the openings 17 at the outer radial edge of the distributor 15, the material S to be centrifuged has an absolute velocity y (see FIG. 3) at which it leaves the distributor (also see FIG. 3). The velocity vector y has a component u in the circumferential direction of the drum 21 as well as a component v, called relative velocity. The relative velocity v may contain a component in the radial direction as well as other components in other directions (for example, axial).

In the case of many products to be centrifuged, the relative velocity component v at the entry of the material S to be centrifuged into the centrifuging chamber 19 should be as small as possible. That is so, for example, in the case of products which have a relatively high tendency to foam or have sensitive structures which must not be destroyed or damaged, as is known in the prior art, such as for flocculents, which should not be destroyed. Thus, in an ideal case, the material S to be centrifuged should enter into the centrifuging chamber 19 only at the circumferential rotating speed of the screw body 3 and without relative velocity v.

In order to reduce the relative velocity v or in order to particularly prevent an excessive acceleration in the radial direction of the material S to be centrifuged, it is provided to equip at least one wall 15*a, d* (see FIG. 3 where both walls 15*a, d* are shown) of the distributor 15, which walls 15*a, d* are at opposite ends of the distributor 15; or, in addition, equip side wall or walls 15*b* (see FIG. 2), perpendicular to walls 15*a, d* or, as an alternative, all walls 15*a, b, d* of the distributor 15 with a surface structure. That surface structure may include projections 27 (see FIGS. 2*a*–2*c* and 3) formed directly on the walls 15*a, b, d* or formed on at least one separate metal plate 29 which can be mounted on the walls 15*a, b, d*. A multilayer arrangement of several metal plates 29, which are situated above one another and have projections 27, can also be implemented (FIG. 3) so that a flow of the material to be centrifuged which flows through the distributor 15 is divided into several portions. One or more of these arrangements of projections 27 essentially takes along the material S to be centrifuged when the distributor 15 is rotated.

The projections 27 are distributed on the at least one wall 15*a, b, d* of the distributor 15 such that at least a predominant portion of the material S to be centrifuged which enters the distributor 15 has to flow around at least one, but preferably several of the projections 27 on the radial path to an outer radial edge or area of the distributor 15.

For ensuring a sufficient "braking effect", the at least one wall 15*a, b, d* is, in addition, preferably provided with projections 27 in essentially such a manner that essentially no radial, or perpendicularly outward-pointing, free flow paths 33 (see FIG. 2*a*) remain for the material S to be centrifuged.

Preferably, the projections 27 are distributed on approximately 30 to 70% of a surface of the at least one wall 15*a, b, d* of the distributor 15.

In addition, the projections 27 are constructed at least in a radial outer area of the at least one distributor wall 15*a, b, d*.

Since centrifugal force $F_z$ acts proportionally to the square of the angular velocity $\omega^2$ and proportionally to a radius r ($F_z=m\omega^2 r$), it immediately becomes clear that acceleration of the material S to be centrifuged is higher in the outer radial area of the distributor 15 than in an inner area, so that in the outer radial area of the distributor 15, a braking effect of the projections 27 counteracts this acceleration. For at least this reason, the projections 27 are preferably also constructed to the outer radial edge of the distributor 15 or to the discharge opening 17 on the wall 15*a* of the distributor 15. A radially interior part of the distributor 15, for example, an interior 30 or 50% of the surface of the wall 15*a*, in contrast, may have a smooth, that is, projection-free construction without significantly reducing the "braking effect."

Since the centrifugal acceleration also becomes higher with an increasing radius r, an embodiment of the present invention may have at least one wall 15*a, b, d* of the distributor, or the metal plate 29 placed upon the wall 15*a*, project by way of the projections 27 radially over the edge of the opening 17 into the centrifuging chamber.

As shown in FIGS. 2*b*, 2*c*, the projections 27 are constructed as cylindrical knobs 27*a, b* and preferably of different diameters, which are fastened, for example, welded, in bores 31 of the plates 29 and possibly in at least one wall 15*a, b, d*.

Alternative geometries of the projections 27 and knobs 27*a, b* are conceivable, such as those having triangular, rectangular, rhombic, spherical and constant diameter cross-sections.

Furthermore, the projections 27 may expand or taper away from the at least one wall 15*a, b d*. Spherical shapes are also conceivable.

The projections 27 extend perpendicular to the at least one distributor wall 15*a, b, d* such that, in the case of a preferred application, for example, the extraction of fruit juice, and, in the case of a maximal throughput of material S to be centrifuged, the projections 27 are at least as high as a liquid level on the at least one wall 15*a, b, d*. The projections 27 are preferably approximately twice as high as an average liquid level.

As an alternative, the projections 27 may be constructed as rods which penetrate the distributor 15 from the wall 15*a* to, for instance, the opposite wall 15*d*.

The knobs 27 may also be constructed as pressed-out areas or may be constructed in a different manner directly in one piece with the at least one wall 15*a, b, d* or the metal plate 29. This one-piece construction may also take place by casting or by a milling-out of a knob structure from a correspondingly thick wall plate.

As shown in FIG. 2*a*, an interior radial area 28 of the wall 15*a* is constructed without projections 27 or knobs 27*a, b*. This interior radial area is followed by a central radial area 30 with four rows of knobs 27*a* aligned parallel to the drum axis A, each knob 27*a* having a first diameter a. The central area is, in turn, followed by an exterior area 32 with three rows of knobs 27*b* which, in comparison to the diameter a, have a smaller diameter b and are also situated closer to one another, so that flow channels 33*b* extending between the knobs 27*b* and aligned diagonally with respect to the drum axis A are narrower than the flow channels 33*a* remaining between the wider knobs 27*a*.

As shown in FIG. 2*a*, the knobs 27*a, b* are in each case arranged in rows which are aligned parallel to the drum axis A. The rows are arranged with respect to one another such that they are axially offset by half the distance between two adjacent knobs 27*a, b*, so that the material S to be centrifuged is prevented from flowing through directly in the radial direction. The axial distance d between the knobs 27*a, b* is slightly larger than the diameter of the knobs 27*a, b*. The distance between the center points of the knobs 27*a, b* in the radial direction corresponds approximately to their respective diameters a, b.

As shown in FIG. 2*a*, the knobs 27*a, b* have a diameter which radially diminishes toward the outer radial edge of distributor 15 in steps. In this case, the flow-through channels 33, 33*a*, 33*b* also become smaller or narrower. This construction causes an increasing braking of the material S to be centrifuged radially from the interior of the distributor 15 toward the exterior; that is, it counteracts the increasing acceleration as a result of the intensifying centrifugal force. In this case, a path which has to be covered by the material S to be centrifuged is extended by the knobs 27*a, b*. Alternatively, the diameter and/or spacing of the knobs 27*a, b* may be constant radially toward the outer radial edge of the distributor 15.

FIGS. 4*a* to 10 show additional variants of projection 27 and knob 27*a, b* structures.

Figure 4A:
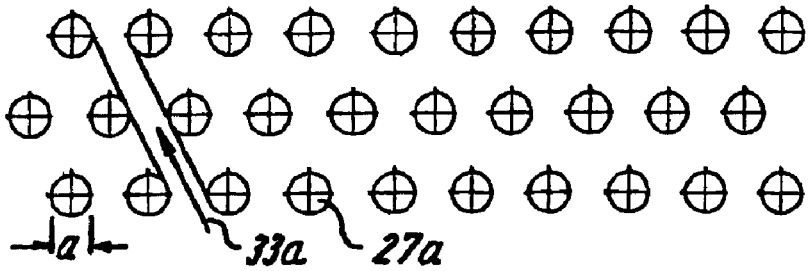
FIG. 4*a* is a view of a cylindrical knob arrangement, according to the present invention.
Figure 4B:
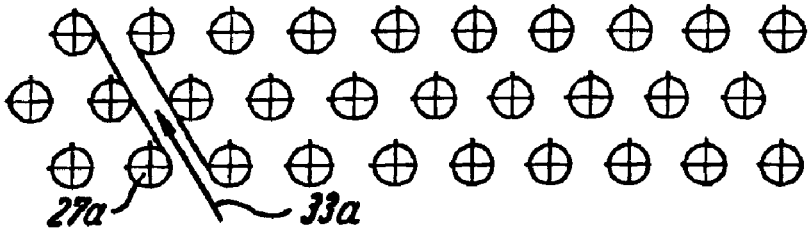
FIG. 4*b* is a view of a cylindrical knob arrangement, according to the present invention.
Figure 4C:
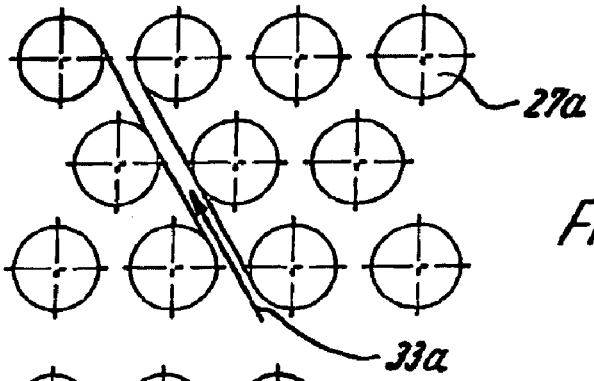
FIG. 4*c* is a view of a cylindrical knob arrangement, according to the present invention.
Figure 4D:
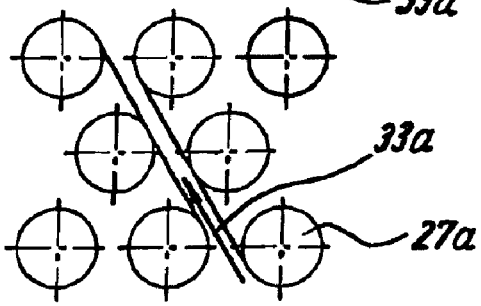
FIG. 4*d* is a view of a cylindrical knob arrangement, according to the present invention.

As shown in FIG. 4*a*, the rows of knobs 27*a* are arranged to be offset with respect to one another by the diameter a of the knob 27*a*. The distance d between the center points or center axes of the cylindrical knobs 27*a* in each row corresponds to the diameter d of these knobs 27*a*.

The respective axial offset of the rows of knobs 27*a, b* relative to one another is reduced from FIG. 4*a* to FIG. 4*d*. In a direction diagonal to the drum axis A, this results in diagonally outward-pointing narrowing flow-through channels 33*a*. These flow channels 33*a* can also be completely avoided if the diameter a, b of the knobs 27*a, b*, respectively, is varied as shown in FIG. 2 or the offset of the rows of knobs 27*a, b* is varied from row to row, or is still further reduced (see FIG. 4*e*). As a result of a suitable design of the knob rows 27*a, b*, many varied flow-through characteristics can be achieved.

It is conceivable to produce the knobs 27*a, b* by cup-shaped cutters, or the knobs 27*a, b* may be constructed in one piece with the wall 15*a* and/or the metal plates 29. Many different materials, such as steel, cast metal or even plastic materials are conceivable for the knobs 27*a, b*. The use of plastic enables the knobs 27*a, b* to be easily bendable or movable, which may increase the braking effect.

Figure 4E:
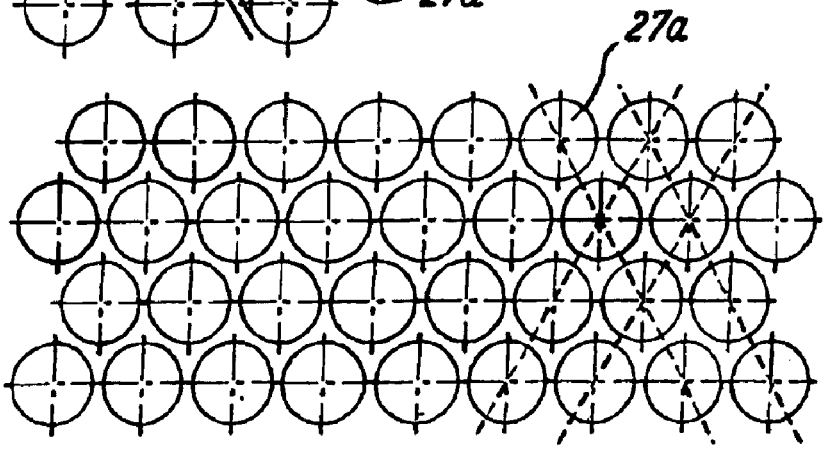
FIG. 4*e* is a view of a cylindrical knob arrangement, according to the present invention.

FIG. 4*e* shows a variant in which the knobs 27*a* of a row have such a narrow distance from one another that, in the case of an axial offset of the knob rows by half the distance between two adjacent knobs 27*a*, no linear flow-through channels 33 remain which extend perpendicularly to the center axis A of the centrifuge.

Figure 5:
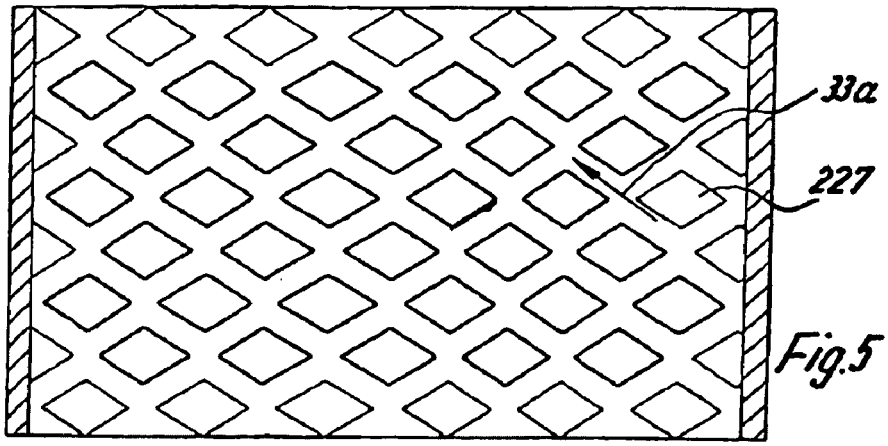
FIG. 5 is a view of a structure of projections on a wall of the distributor, according to the present invention.

As shown in FIG. 5, the projections 227 have a rhombic shape. Connection lines (not shown) of tips of the rhombuses 227 are situated perpendicular and parallel to the center axis A of the centrifuge. Furthermore, the tips of the rhombuses 227 point to one another in the different rhombus rows. Flow-through ducts 33*a* remain between the rhombuses 227 in a diagonal or sloped direction with respect to the center axis A. The rhombuses 227 can be produced, for example, by milling.

Figure 6A:
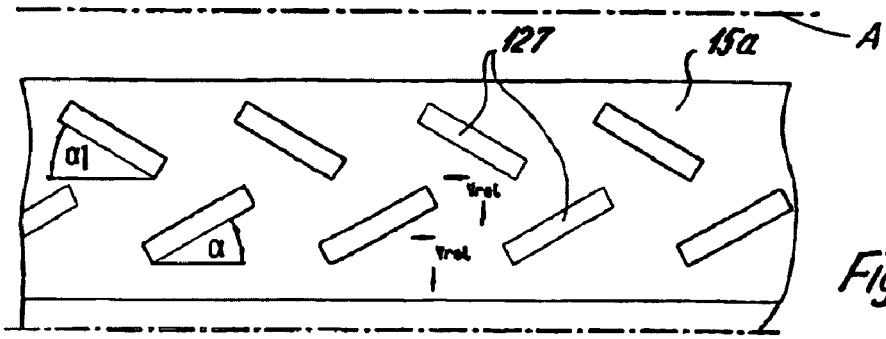
FIG. 6*a* is a view of a structure of projections on a wall of the distributor, according to the present invention.
Figure 6B:
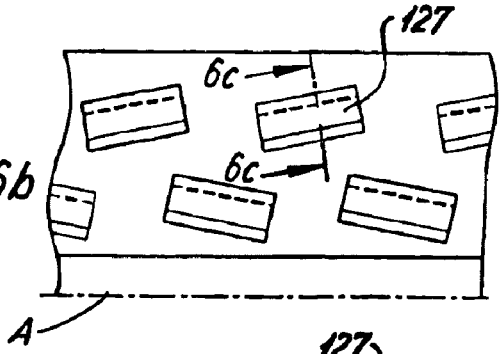
FIG. 6*b* is a view of a structure of projections on a wall of the distributor, according to the present invention.

FIG. 6*a* shows a variant of the present invention in which, instead of rows of knobs 27*a, b*, at least two rows of plate metal strips 127 are fastened to the wall 15*a* of the distributor.

These plate metal strips 127 are each angularly oriented with respect to the center axis A of the centrifuge and are situated so close to one another in mutually oppositely angularly offset rows that again no flow-through channels remain on the distributor wall 15*a* in the radial direction but a considerable deflection and braking takes place. As shown in FIG. 6*a*, angle α, α1 amounts to approximately 30°. The smaller the angle α, α1 with respect to the center axis A, the higher the velocity $v_{ref}$ may be, so that no deposits will form on the plate metal strips 127. It is also conceivable that the angle α, α1 may be reduced toward the outside, optionally to a zero value.

Figure 6C:
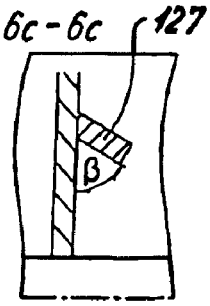
FIG. 6*c* is a sectional view of a structure of projections on a wall of the distributor, according to the present invention.
Figure 6D:
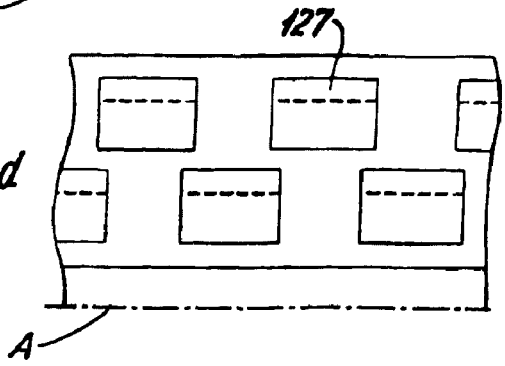
FIG. 6*d* is a view of a structure of projections on a wall of the distributor, according to the present invention.
Figure 6E:
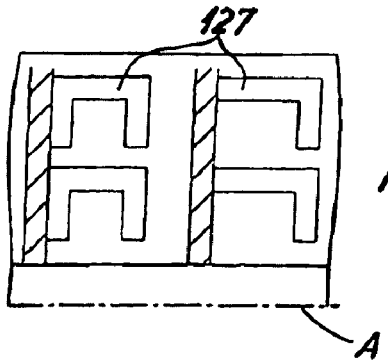
FIG. 6*e* is a partial sectional view of a structure of projections on a wall of the distributor, according to the present invention.

It is also conceivable that the plate metal strips 127 would not be situated perpendicularly on the wall 15*a* of the distributor 15 but at an angle β (see FIG. 6*b*) and/or are constructed and/or arranged in an L-shape or U-shape or T-shape (see, for example, FIGS. 6*c* and 6*d*). At high-speed locations, the angle α, α1 with respect to the center axis should be larger than at lower-speed locations.

Figure 7:
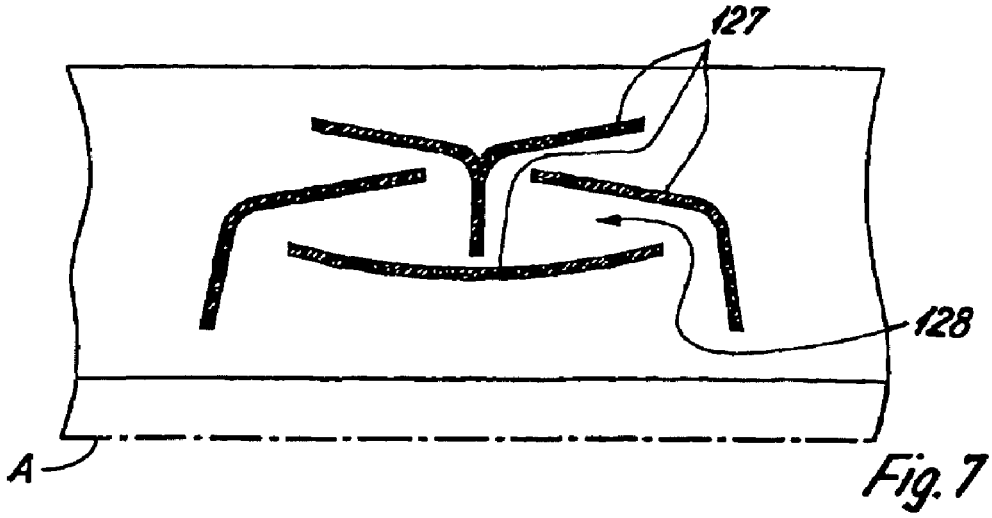
FIG. 7 is a view of an embodiment of the present invention including metal plates and a labyrinth arrangement.

FIG. 7 illustrates another embodiment of the present invention. A relatively flat metal plate 127 leads to an intensive braking and a labyrinth arrangement 128, including additional bent metal plates 127, is designed such that no radial flow-through can take place.

Figure 8A:
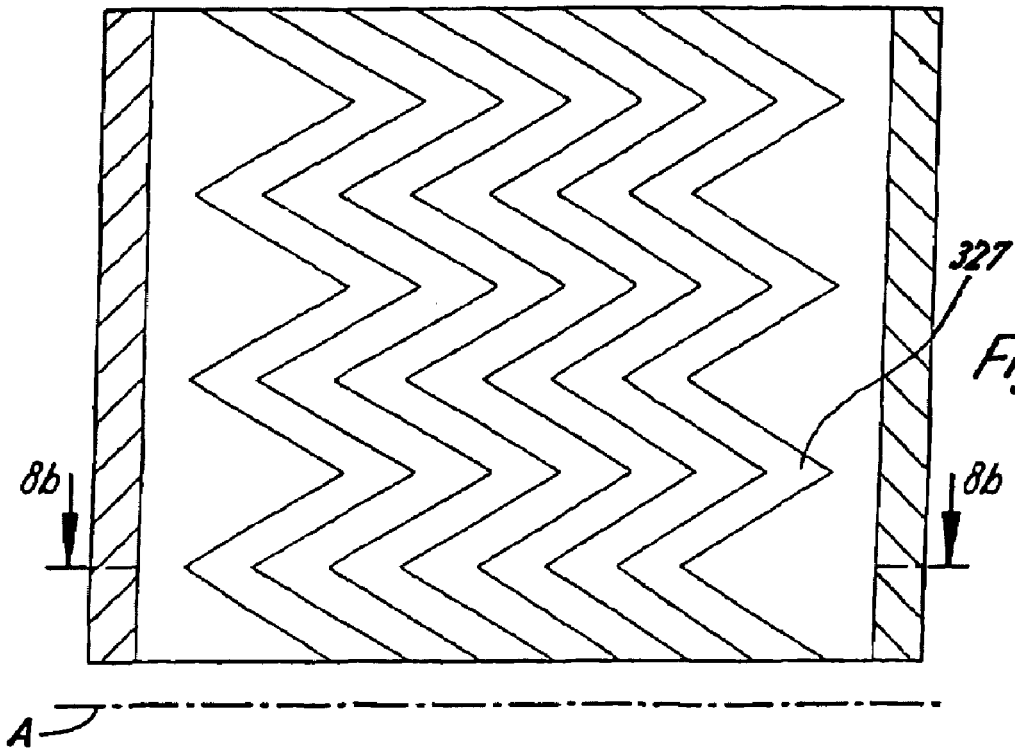
FIG. 8*a* is a view of projections having a meander shape, according to the present invention.
Figure 8B:
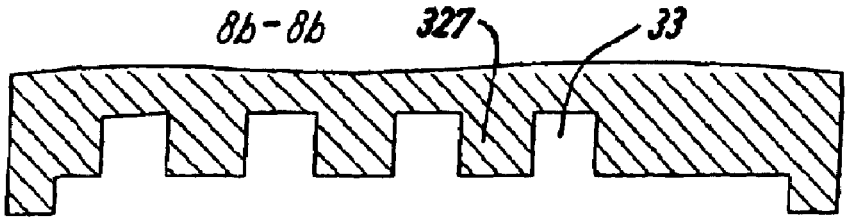
FIG. 8*b* is a sectional view of projections having a meander shape, according to the present invention.

As shown in FIGS. 8*a* and 8*b*, the projections 327 have a type of meander shape. The zigzag-type meanders 327 engage in one another such that no flow-through channels 33 remain in the distributor 15 radially to the outer radial edge.

Figure 9:
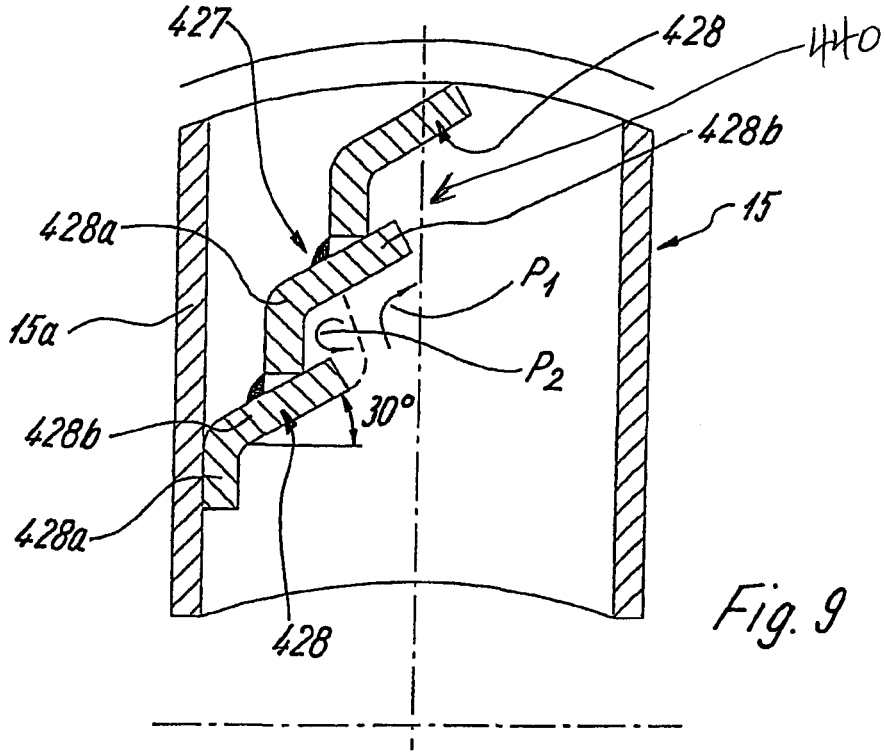
FIG. 9 is a sectional view of an embodiment of the present invention having a type of step-shaped surface structure.
Figure 10:
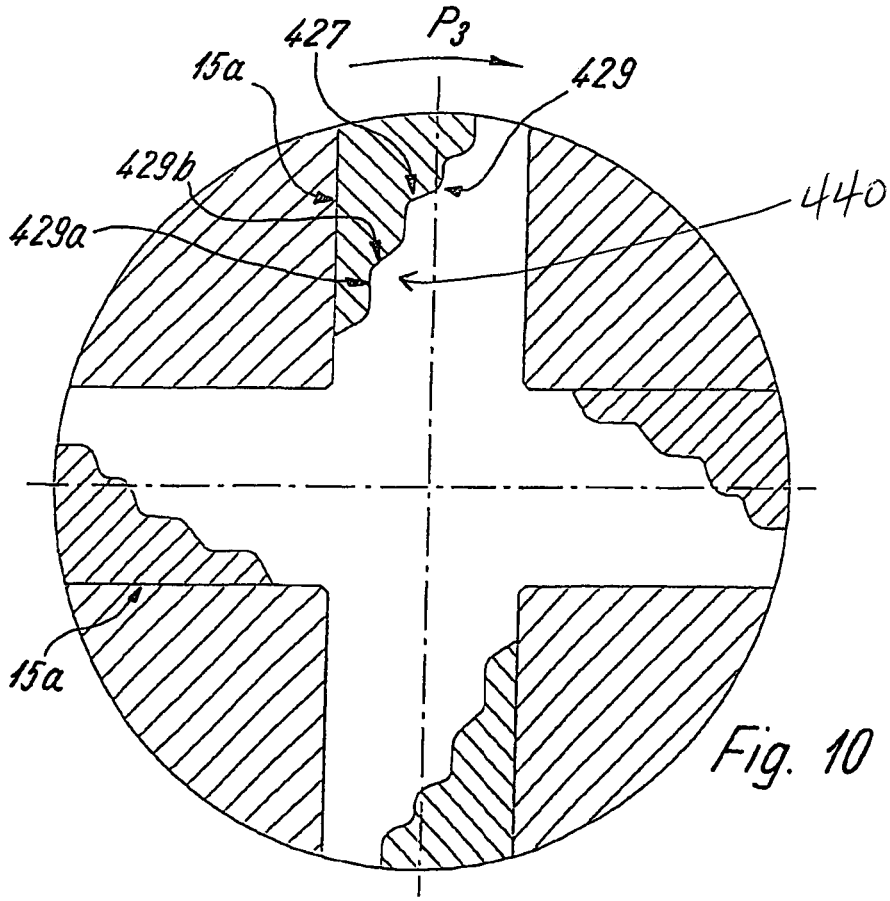
FIG. 10 is a different sectional view of the step-shaped structure of FIG. 9.
Figure 11:
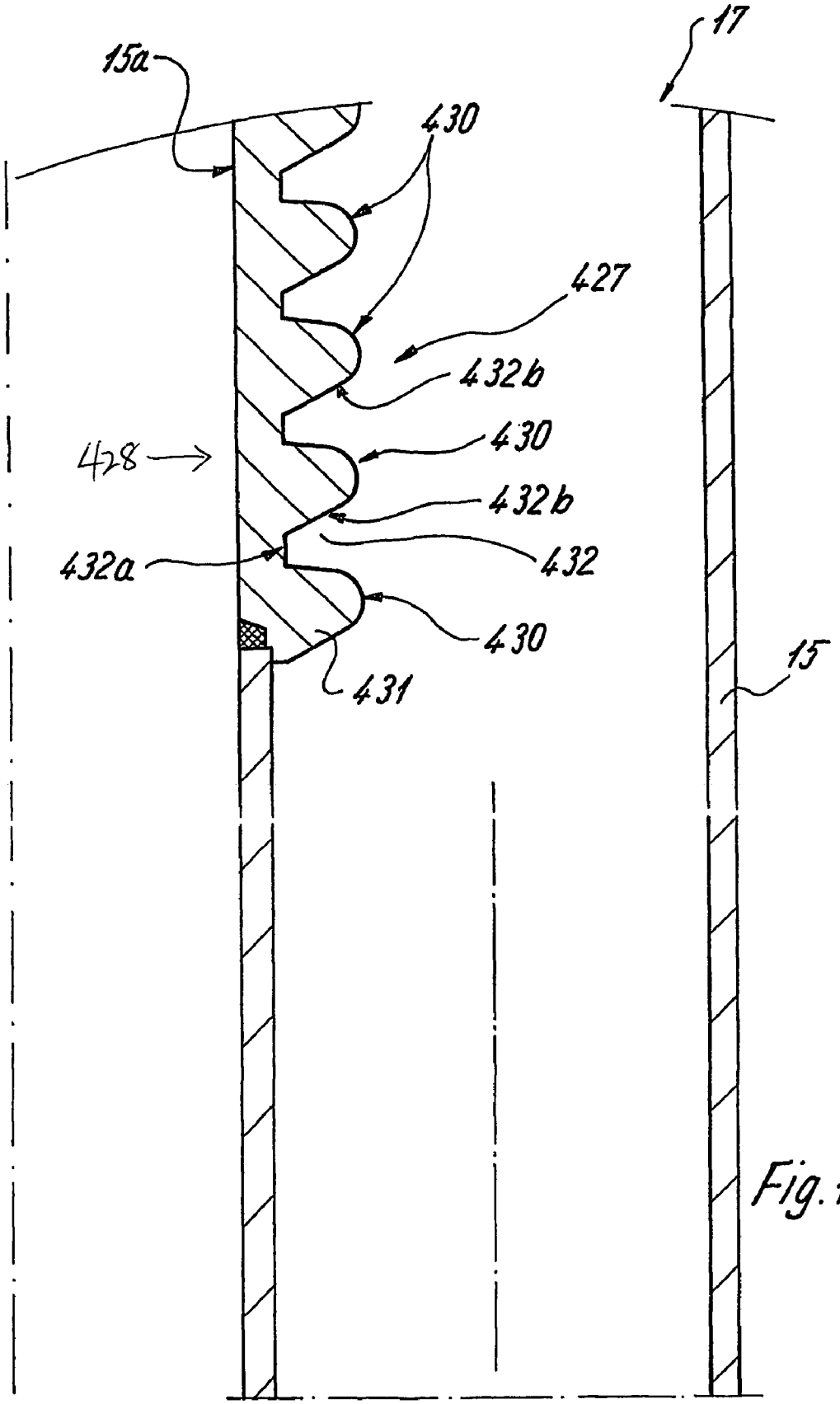
FIG. 11 is a sectional view of an embodiment of the present invention showing a waterfall-type braking inflow as a step contour.

As shown in FIGS. 9 to 11, a type of step-shaped surface structure or step construction 427 is formed in the distributor 15 or on the walls 15*a*. As shown in FIG. 9 as well as in FIG. 10, liquid flow has to take place over "steps" 440 in a circumferential direction. The effect will be optimal if the step construction 427 extends into the liquid level.

As shown in FIG. 9, a step contour is produced from several metal plates 428 configured to rest on and/or against one another in the circumferential direction. As alternatives, the contour may also be shaped from one workpiece by milling and may be made of metal and/or plastic.

The metal plates 428 have an angular cross-section; that is, they each include a section 428*a* which extends essentially parallel to the distributor wall 15*a*, and a section 428*b* which is angular thereto and which, as an example, has an inclination of approximately 30° to a perpendicular line from the distributor wall 15*a*.

Section 428*a* of a first metal plate 428 may extend essentially parallel to the distributor wall 15*a* and may be placed directly onto the distributor wall 15*a*. The sections of the metal plates 428 which follow, which sections extend parallel to the distributor wall 15*a*, are mounted on back sides of angular sections 428*b* of the preceding metal plates 428, so that a type of swirling space is formed between the successive metal plates 428.

When a liquid stream from one step or one metal plate 428 impacts on the next step or the next metal plate 428, the liquid stream is directed (see FIG. 9) in a flow direction and against the metal plates 428 into different directions and is swirled which, in turn, causes a braking effect.

Since the metal plates 428 are offset with respect to one another, the liquid stream moves slightly against rotating direction P3 (see FIG. 10).

During impact, the liquid stream is divided in the rotating direction and against the rotating direction (see FIG. 9, arrows P1, P2). This division and the swirling of the liquid stream provides a braking effect. The braking effect includes the effect of diagonal sections of the metal plates 428 and a shadow effect of the swirlings (see FIG. 9, arrow P2).

FIG. 10 differs from FIG. 9 not only in that the step construction 427 in FIG. 10 is in one piece as a cast or milled part but also in that the step construction 427 is designed such that section 429*a* of steps 429 extend essentially parallel to the distributor wall 15*a* and adjoins ends of angular sections 429*b* of the preceding step 429, so that no swirling space is created between successive steps 429.

FIG. 11 shows an alternative embodiment to FIGS. 9 and 10. In FIG. 11, a "waterfall-type braking inflow" is included. Step contour 427 is shown having individual steps 430 formed by rows of projections 431 extending essentially parallel to the drum axis A. Rows of grooves 432 may be milled into plate 428. The rows of grooves 432, in turn, have an angular cross-section; that is, they each include a section 432*a* extending essentially parallel to the distributor wall 15*a* and of a section 432*b* which is at an angle to section 432*a* and has, for example, a slope of approximately 30° to a line perpendicular to the distributor wall 15*a*. The sections of the rows of grooves 432*a*, which each extend essentially parallel to the distributor wall 15*a*, are essentially mutually aligned. That is, they are situated in a plane. That reduces the costs of the manufacturing in comparison to the embodiment of FIG. 10 because there is less waste during the milling or less required casting material. As mentioned, the diagonal section 432*b* has an angle of approximately 30° with respect to the perpendicular line from the distributor wall 15*a*, and the impacting of a liquid stream on the next step 430 also takes place at an angle of, for example, 30°.

Figure 12:
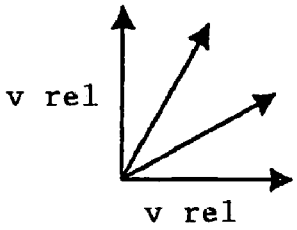
FIG. 12 shows two diagrams illustrating relative velocities of the material to be centrifuged, according to the present invention and one diagram illustrating relative velocities according to the prior art.
Figure 12:
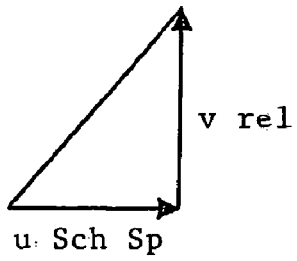
Figure 12:
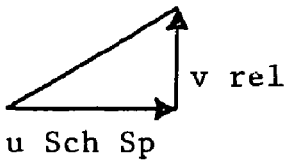

FIG. 12 shows possible directions of relative velocities. It also shows, diagrammatically, the relative velocity component $v_{rel}$ of the material to be centrifuged at the outer radial edge of the distributor 15 with measures for reducing the radial drive of the relative velocities of the present invention, as well as the prior art without those measures.

Although the present invention has been described and illustrated in detail, it is to be clearly understood that this is done by way of illustration and example only and is not to be taken by way of limitation. The scope of the present invention is to be limited only by the terms of the appended claims.

The invention claimed is:

1. A solid bowl screw centrifuge, comprising:

a centrifuging chamber having a rotatable screw with a center axis;

a rotatable drum surrounding the centrifuging chamber;

an axially extending inflow tube for guiding material to be centrifuged into a distributor, the distributor being oriented in a substantially perpendicular manner with respect to the center axis of the screw and configured for introducing the material to be centrifuged into the centrifuging chamber;

the distributor further including at least one wall having a surface structure that includes projections configured such that a substantial portion of the material to be centrifuged flowing through the distributor must flow around at least one of the projections on an essentially radial path that extends in a direction of a centrifugal force such that the projections exercise a braking effect which counteracts an acceleration of the material to be centrifuged; and wherein the at least one wall of the distributor has at least two radially and mutually offset rows of projections, the projections being axially offset with respect to one another such that essentially neither radial flow channels nor flow channels which extend essentially in the direction of the centrifugal force are formed on the at least one wall.

2. The solid bowl screw centrifuge according to claim 1 wherein the projections are constructed cross-sectionally as one or more of circular, rhombic and n-cornered knobs.

3. The solid bowl screw centrifuge according to claim 2, wherein the knobs have a contour which one of tapers and widens from the at least one wall of the distributor.

4. The solid bowl screw centrifuge according to claim 2, wherein the knobs are constructed as one monolithic piece with one or more of the at least one wall and at least one metal plate mounted on the at least one wall.

5. The solid bowl screw centrifuge according to claim 2, wherein the knobs are essentially perpendicular to the at least one wall and have a height such that, for a maximal throughput of the material to be centrifuged, a liquid level at the at least one wall is lower than the height of the knobs.

6. The solid bowl screw centrifuge according to claim 2, wherein one or more of the diameter and spacing of the knobs is constant radially toward an outer radial edge of the distributor.

7. The solid bowl screw centrifuge according to claim 2, wherein the knobs have a contour that is one or more of circular, spherical and have a constant diameter.

8. The solid bowl screw centrifuge according to claim 1 wherein the projections are formed at least in an exterior radial area of the distributor.

9. The solid bowl screw centrifuge according to claim 1, wherein the surface structure with the projections covers approximately at least 40% of a surface of the at least one wall.

10. The solid bowl screw centrifuge according to claim 1, wherein the projections are constructed cross-sectionally as one or more of circular, rhombic and n-cornered knobs.

11. The solid bowl screw centrifuge according to claim 1, wherein the projections have a meander shape.

12. The solid bowl screw centrifuge according to claim 1, wherein the surface structure with the projections covers approximately 30–50% of a surface of the at least one wall.

13. A solid bowl screw centrifuge, comprising:

a centrifuging chamber having a rotatable screw with a center axis;

a rotatable drum surrounding the centrifuging chamber;

an axially extending inflow tube for guiding material to be centrifuged into a distributor, the distributor being oriented in a substantially perpendicular manner with respect to the center axis of the screw and configured for introducing the material to be centrifuged into the centrifuging chamber;

the distributor further including at least one wall having a surface structure that includes projections configured such that a substantial portion of the material to be centrifuged flowing through the distributor must flow around at least one of the projections on an essentially radial path that extends in a direction of a centrifugal force such that the projections exercise a braking effect which counteracts an acceleration of the material to be centrifuged; and wherein the projections have a meander shape.

14. A solid bowl screw centrifuge, comprising:

a centrifuging chamber having a rotatable screw with a center axis;

a rotatable drum surrounding the centrifuging chamber;

an axially extending inflow tube for guiding material to be centrifuged into a distributor, the distributor being oriented in a substantially perpendicular manner with respect to the center axis of the screw and configured for introducing the material to be centrifuged into the centrifuging chamber;

the distributor further including at least one wall having a surface structure that includes projections configured such that a substantial portion of the material to be centrifuged flowing through the distributor must flow around at least one of the projections on an essentially radial path that extends in a direction of a centrifugal force such that the projections exercise a braking effect which counteracts an acceleration of the material to be centrifuged; and wherein the projections include one or more plate metal strips.

15. The solid bowl screw centrifuge according to claim 14, wherein the plate metal strips are each oriented at an angle of approximately 30° with respect to the center axis and are situated close to one another in mutually angularly offset rows such that no flow-through channels exist in a radial direction on the at least one distributor wall.

16. The solid bowl screw centrifuge according to claim 15, wherein the angle decreases between the plate metal strips and the center axis with one or more of an increasing radius of the distributor and an increasing distance of the plate metal strips from the center axis.

17. The solid bowl screw centrifuge according to claim 14, wherein the one or more plate metal strips are produced by one or more of welding and milling.

18. A solid bowl screw centrifuge, comprising:

a centrifuging chamber having a rotatable screw with a center axis;

a rotatable drum surrounding the centrifuging chamber;

an axially extending inflow tube for guiding material to be centrifuged into a distributor, the distributor being oriented in a substantially perpendicular manner with respect to the center axis of the screw and configured for introducing the material to be centrifuged into the centrifuging chamber;

the distributor further including at least one wall having a surface structure that includes projections configured such that a substantial portion of the material to be centrifuged flowing through the distributor must flow around at least one of the projections on an essentially radial path that extends in a direction of a centrifugal force such that the projections exercise a braking effect which counteracts an acceleration of the material to be centrifuged;

wherein the projections include one or more plate metal strips; and wherein the plate metal strips form a labyrinth arrangement.

19. A solid bowl screw centrifuge, comprising:

a centrifuging chamber having a rotatable screw with a center axis;

a rotatable drum surrounding the centrifuging chamber;

an axially extending inflow tube for guiding material to be centrifuged into a distributor, the distributor being oriented in a substantially perpendicular manner with respect to the center axis of the screw and configured for introducing the material to be centrifuged into the centrifuging chamber;

the distributor further including at least one wall having a surface structure that includes projections configured such that a substantial portion of the material to be centrifuged flowing through the distributor must flow around at least one of the projections on an essentially radial path that extends in a direction of a centrifugal force such that the projections exercise a braking effect which counteracts an acceleration of the material to be centrifuged;

wherein the projections are constructed cross-sectionally as one or more of circular, rhombic and n-cornered knobs;

wherein the knobs are constructed as one monolithic piece with one or more of the at least one wall and at least one metal plate mounted on the at least one wall; and wherein the knobs are welded into one or more of bores of the metal plate and the at least one wall.

20. The solid bowl screw centrifuge according to claim 19, wherein the knobs on the at least one metal plate extend through a circumferential wall of the screw body into the centrifuging chamber.

21. A solid bowl screw centrifuge, comprising:

a centrifuging chamber having a rotatable screw with a center axis;

a rotatable drum surrounding the centrifuging chamber;

an axially extending inflow tube for guiding material to be centrifuged into a distributor, the distributor being oriented in a substantially perpendicular manner with respect to the center axis of the screw and configured for introducing the material to be centrifuged into the centrifuging chamber;

the distributor further including at least one wall having a surface structure that includes projections configured such that a substantial portion of the material to be centrifuged flowing through the distributor must flow around at least one of the projections on an essentially radial path that extends in a direction of a centrifugal force such that the projections exercise a braking effect which counteracts an acceleration of the material to be centrifuged;

wherein the projections are constructed cross-sectionally as one or more of circular, rhombic and n-cornered knobs; and wherein one or more of the diameter and spacing of the knobs decreases radially toward an outer radial edge of the distributor.

22. A solid bowl screw centrifuge, comprising:

a centrifuging chamber having a rotatable screw with a center axis;

a rotatable drum surrounding the centrifuging chamber;

an axially extending inflow tube for guiding material to be centrifuged into a distributor, the distributor being oriented in a substantially perpendicular manner with respect to the center axis of the screw and configured for introducing the material to be centrifuged into the centrifuging chamber;

the distributor further including at least one wall having a surface structure that includes projections configured such that a substantial portion of the material to be centrifuged flowing through the distributor must flow around at least one of the projections on an essentially radial path that extends in a direction of a centrifugal force such that the projections exercise a braking effect which counteracts an acceleration of the material to be centrifuged; and wherein the projections on the at least one wall extend through a circumferential wall of the screw body into the centrifuging chamber.

23. A solid bowl screw centrifuge, comprising:

a centrifuging chamber having a rotatable screw with a center axis;

a rotatable drum surrounding the centrifuging chamber;

an axially extending inflow tube for guiding material to be centrifuged into a distributor, the distributor being oriented in a substantially perpendicular manner with respect to the center axis of the screw and configured for introducing the material to be centrifuged into the centrifuging chamber;

the distributor further including at least one wall having a surface structure that includes projections configured such that a substantial portion of the material to be centrifuged flowing through the distributor must flow around at least one of the projections on an essentially radial path that extends in a direction of a centrifugal force such that the projections exercise a braking effect which counteracts an acceleration of the material to be centrifuged; and wherein several stacked layers of metal plates having projections are arranged on the at least one wall of the distributor, so that a flow of the material to be centrifuged which flows through the distributor is divided into several portions.

24. The solid bowl screw centrifuge according to claim 23, wherein one or more of the projections and metal plates are made of one or more of steel, cast metal, plastic material and rubber.

25. A solid bowl screw centrifuge, comprising:

a centrifuging chamber having a rotatable screw with a center axis;

a rotatable drum surrounding the centrifugal chamber;

an axially extending inflow tube for guiding material to be centrifuged into a distributor, the distributor being oriented in a substantially perpendicular manner with respect to the center axis of the screw and configured for introducing the material to be centrifuged into the centrifuging chamber; and the distributor further including at least one wall having a step-shaped surface structure extending in a circumferential direction.

26. The solid bowl screw centrifuge according to claim 25, wherein the step-shaped surface structure includes several metal plates configured to one or more of rest on and against one another in the circumferential direction.

27. The solid bowl screw centrifuge according to claim 26, wherein the metal plates have an angular cross-section and each metal plate includes a section extending essentially parallel to the at least one wall and a section which is at an angle to the at least one distributor wall.

28. The solid bowl screw centrifuge according to claim 27, wherein a section of a first metal plate which extends essentially parallel to the at least one wall is placed directly onto the at least one wall, and sections of the metal plates which follow the first metal plate extend essentially parallel to the at least one wall and are each mounted on back sides of the angular sections of the preceding metal plates, so that a swirling space is created between successive metal plates.

29. The solid bowl screw centrifuge according to claim 25, wherein the step-shaped surface structure is made from one of a one-piece metallic and a one-piece plastic body.

30. The solid bowl screw centrifuge according to claim 25, wherein the step-shaped surface structure is configured such that a section of each step that extends essentially parallel to the at least one wall adjoins an end of an angular section of the preceding step.

31. The solid bowl screw centrifuge according to claim 25, wherein individual steps are formed by rows of grooves extending essentially parallel to the center axis, which rows of grooves have an angular cross-section.

32. The solid bowl screw centrifuge according to claim 31, wherein sections of the rows of grooves extend essentially parallel to the at least one wall and are essentially situated in a plane.

* * * * *